United States Patent [19]

Belanger

[11] 4,271,649

[45] Jun. 9, 1981

[54] STRUCTURAL PANEL

[75] Inventor: Germain Belanger, St. Germain de Grantham, Canada

[73] Assignee: Bombardier Limited, Quebec, Canada

[21] Appl. No.: 28,596

[22] Filed: Apr. 9, 1979

[51] Int. Cl.[3] ..... E06B 3/00; E04C 2/34; E04C 2/38

[52] U.S. Cl. ..... 52/309.2; 49/503; 52/309.15; 52/809; 52/823; 428/438; 428/481; 428/537

[58] Field of Search ..... 428/438, 481, 537; 264/258; 49/501, 503; 52/309.15, 309.1, 785, 809, 813, 309.2, 823

[56] References Cited

U.S. PATENT DOCUMENTS

| | | | |
|---|---|---|---|
| 2,782,465 | 2/1957 | Palmer, Jr. | 52/309.15 |
| 2,893,075 | 7/1959 | Potchen et al. | 52/823 X |
| 2,924,860 | 2/1960 | Parham, Jr. et al. | 49/501 |
| 3,223,056 | 12/1965 | Wilburn | 52/309.15 X |
| 3,692,620 | 9/1972 | Schmidt et al. | 428/537 X |
| 4,082,882 | 4/1978 | Weinstein et al. | 428/537 X |
| 4,083,159 | 4/1978 | Hatch et al. | 52/809 X |

FOREIGN PATENT DOCUMENTS

| | | | |
|---|---|---|---|
| 1397431 | 3/1965 | France | 52/785 |
| 2121402 | 8/1972 | France | 428/537 |

*Primary Examiner*—Alfred C. Perham
*Attorney, Agent, or Firm*—Larson and Taylor

[57] ABSTRACT

A structural panel such as a door for a railway freight car has a lightweight core formed by two sheets of low density material e.g. balsa wood. Each sheet has bonded to one side a series of layers of glass fibre, and the sheets are bonded together in confronting relationship to form the panel. The glass fibre layers extend around the edges of the panel which edges are further reinforced by a channel-shaped plastics edging member.

8 Claims, 3 Drawing Figures

STRUCTURAL PANEL

BACKGROUND OF THE INVENTION

This invention relates to a new or improved structural panel and to a method of fabrication for the same. Structural panels built in accordance with the invention are suitable for many uses and can be designed, for example, as hatches and bulkheads for boats, component parts for vehicles such as trucks, and for various applications in buildings.

DESCRIPTION OF THE PRIOR ART

In the particular application hereinafter described, the structural panel is designed as a sliding door for a railway freight car. Freight car doors are generally of very large size, typically measuring eight feet by ten feet, and hitherto have usually been manufactured in sheet metal. For installation, the freight car door is normally suspended on an overhead rail at the upper edge of the side of the freight car or carried on a base rail at the bottom of the doorway, and is moved along the rail to open or close the entrance to the freight car. Such sheet metal freight car doors are heavy, but despite this, they are very susceptible to damage, for example, through collision with loading equipment such as a fork lift truck when goods are being loaded into or removed from the freight car. Existing doors can very easily be bent out of shape through such accidental damage, thus rendering the freight car unserviceable until the door has been repaired or replaced. Even when the extent of the damage is not such as to warrant withdrawal of the freight car from service for repairs, often the door becomes distorted and misaligned to an extent such that it requires excessive force to open and close it. The increased operating force required as a result of the damage cannot be applied manually, so that in practice mechanical handling equipment, such as a fork-lift truck, is used to open and close the door. This in turn leads to the door being further damaged, until in time it is rendered totally unserviceable.

SUMMARY OF THE INVENTION

The present invention provides a structural panel comprising laminated planar outer layers of resin bonded glass fibre arranged on opposite faces of a relatively thick, light-weight core matrix, said core matrix comprising two sheets of low density material each bonded to the glass fibre outer layers on one side of the panel, and bonded together in confronting relationship in the neutral plane of the panel.

The core sheets are preferably of balsa wood arranged with the grain extending in the direction of the thickness of the panel, the balsa wood sheets being resin bonded together on opposite sides of a central layer of glass fibre. The laminated outer layers of resin bonded glass fibre may be extended in overlapping relationship around the edges of the lightweight core matrix, and the edges of the panel reinforced by superimposed U-shaped channel members.

A structural panel designed as a sliding door for a railway freight car is significantly lighter than the existing sheet metal door, and although somewhat more expensive to manufacture, is very much less susceptible to damage in service, and even if damaged can usually be repaired in situ has minimizing the down time of the freight car. The reduced susceptibility to damage is a result of the natural resiliency of the composite glass fibre construction of the door. Tests have demonstrated that a freight car door constructed as herein described can recover resiliently without permanent deformation from impacts which would bend a sheet metal door sufficiently to render it unserviceable.

From another aspect, the invention provides a method of fabricating a structural panel comprising building two complementary panel sub-assemblies by the steps of: (a) laying up in a mould a succession of layers of glass fibre material and coating said layers with bonding resin; and (b) applying a sheet of balsa wood to said coated layers before the resin coating of the uppermost glass fibre layer has cured, said balsa wood sheet having its grain extending perpendicular to said layers; and joining said sub-assemblies together by applying bonding material to the exposed face of the balsa sheet of each panel arranging these faces in confronting relationship and pressing the sub-assemblies together to form a bond.

By providing the lightweight balsa wood core in two sheets, one is able to ensure that good bonding is achieved between the balsa wood and the outer layers of glass fibre material on each side of the panel and furthermore additional strength may be imparted to the panel if one or more layers of glass fibre material are bonded between the two balsa wood sheets in the finished product.

Furthermore, this method of construction results in good dimensional stability of the structural panel particularly of a panel of the size of a freight car door. Resin bonded glass fibre laminates undergo slight shrinkage upon curing so that a panel as large as a freight car door could become warped during manufacture and incapable of proper alignment. In the fabrication method of the invention the individual panel sub-assemblies are also subject to shrinkage of the bonded glass fibre layers upon curing. However, the sub-assemblies deform in opposite directions, becoming outwardly convex on the side of the balsa wood sheet. Thus when the two sub-assemblies are brought together and bonded the tendency of one sub-assembly to revert to its deformed condition is counteracted by that of the other, so that the resultant panel is remarkably true and unwarped. Typically in a panel for a freight car door measuring 8 feet by 10 feet the warpage is of the order of 1/16 inch or less.

BRIEF DESCRIPTION OF THE DRAWINGS

The invention will further be described, by way of example only, with reference to the accompanying drawings, wherein.

DESCRIPTION OF THE PREFERRED EMBODIMENT

Figure 1:
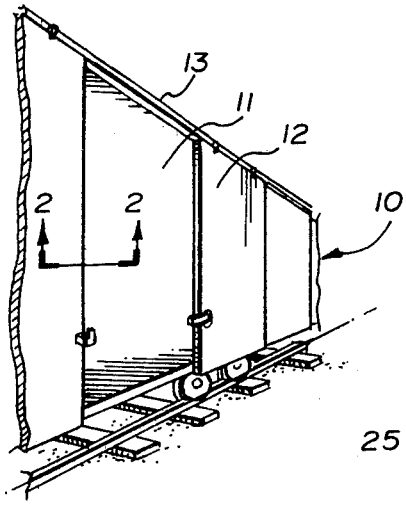
FIG. 1 is a partial perspective view of a railway freight car.

FIG. 1 shows the side of a railway freight car 10 having a large loading opening 11 which may be closed by a sliding door 12 suspended to move on an overhead rail 13 extending along the upper edge of the freight car.

The freight car door 12 is very large, typical dimensions being 8 feet by ten feet by 2 or 2.5 inches thick.

Figure 2:
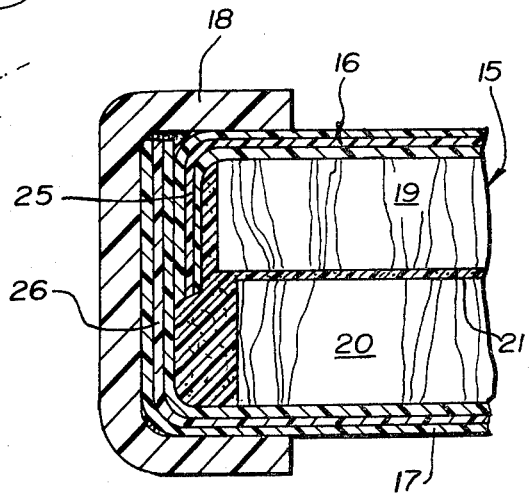
FIG. 2 is a sectional view taken on the line 2—2 in FIG. 1 illustrating the construction of the freight car door.

The construction of the door 12 is illustrated in FIG. 2 as comprising a lightweight core matrix generally designated at 15 enclosed between multi-laminar glass fibre outer layers 16 and 17, the edges of the door being reinforced by a U-shaped plastic moulding 18.

The core matrix 15 comprises two sheets 19 and 20 of balsa wood sandwiched on opposite sides of and resin bonded to a central sheet 21 of glass fibre material.

Figure 3:
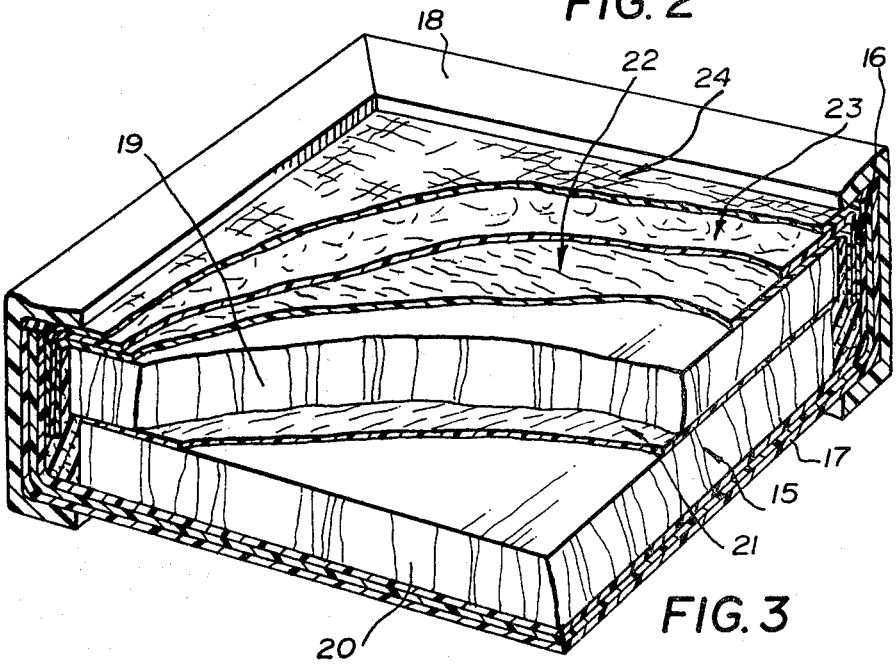
FIG. 3 is a perspective view of a corner section of the railway freight car door, with parts broken away to illustrate the overall construction.

As can be seen most clearly in FIG. 3, each of the multi-laminar glass fibre outer layers 16 and 17 comprises a layer 22 of unidirectional glass fibres bonded to the balsa wood, one or more layers of random fibre glass fibre mat 23 and an outer layer of woven roving glass fibre 24.

As best seen in FIG. 2, the edges of the multi-laminar outer layer 16 are extended around the end surfaces of the balsa wood sheet 19, and at 25 and the edges of the outer layers 17 are likewise extended as at 26 and overlap the extension 25, the interstices between the extension 25 and 26, and the core matrix 15 being filled with the same polyester resin which is used for bonding of the layers 16 and 17.

The peripheral plastic moulding 18 can be secured to the panel by any means, as by bonding, threaded fasteners, etc.

The door 12 is manufactured in two sub-assemblies, by laying up in a mould the layers 24, 23 and 22 each layer being thoroughly coated by polyester resin prior to the next layer being applied. Depending upon the particular application required, the number of layers of glass fibre roving, mat, and unidirectional fibre may be varied as desired. The mold is first coated with a polyester gel coat resin giving a smooth gel coat of 0.018 inch thickness. Each of the multi-laminar outer layers has a total thickness of about 0.025 inch, and has a high glass fibre content, the specific type of fibre reinforcement being chosen to achieve an isotropic structural performance with a high resistance to delamination.

After the layer 22 of uni-directional fibre has been laid up and coated, and before the polyester resin has cured, the balsa wood sheet 19 is applied to it. This may comprise a series of small blocks of balsa wood arranged with the grain extending at right angles to the sheets 22 to 24. Since the polyester resin had not cured, good bonding of the balsa wood sheet 19 to the multi-laminar glass fibre outer layers 16 is effected.

A second sub-assembly comprising the outer layer 17 and the balsa wood sheets 20 is fabricated in exactly similar manner, and once the two sub-assemblies are cured, they are brought together in confronting relationship and resin bonded together on opposite sides of a central glass fibre sheet 21. The peripheral plastic moulding 18 is then applied, and any desired hardware attached. If required, hardware such as mounting plates for locks, rollers etc. may be bonded within the door structure during the manufacturing process.

The fibres of the unidirectional layers 22 are aligned at a predetermined angle in the range 30° to 60° to the sides of the panel. For a generally square panel the angle is about 45° and for long narrow panels the angle will approach 60°. Furthermore, to improve the strength of the product, and particularly to facilitate the handling of the sub-assemblies, a laminate cover layer of glass fibre material may be included as part of the bonding material applied to the exposed face of the balsa layer of each sub-assembly. The sub-assemblies can then be bonded by a coating of resin applied over each cover layer.

In an alternative construction (not illustrated) the folded over extensions 25, 26 of the sub-assemblies can be omitted so that each is of substantially uniform construction throughout its area. The sub-assemblies can thus be cut out of larger sheets or trimmed to size as by sawing. The stiffness and strength of the edges of panels produced by this method will be reduced, but this can be compensated for by increasing the size and strength of the peripheral moulding 18.

A freight car door manufactured as described above has proved to be considerably more durable in service than the known sheet metal doors. Furthermore, whereas existing sheet metal doors have a weight of between 600 and 700 pounds the corresponding door fabricated as described above weighs approximately 550 pounds. By virtue of its composition, the improved door is much less susceptible to damage, since it has a degree of flexibility, and can therefore absorb impact much more readily than a sheet metal door. Doors manufactured as described above typically can sustain a bending deflection of 3 inches without damage or permanent deformation. In addition to the resistance to static loads, the improved freight car door can absorb an impact load up to four times greater than a sheet metal door without permanent deformation. The resistance of the door to puncture, as when pierced by the tine of fork-lift truck, is not markedly improved. However, because of the bonded glass fibre construction, even when so punctured the door can be repaired relatively easily and cheaply without having to be removed from the freight car.

Additional advantages of a freight car door constructed as described above are durability and long life, arising from its resistance to: abrasion, wear, corrosion and extremes of atmospheric conditions. In addition to the improved resistance to stress and impact, the improved door is highly resistant to vibration and fatigue and has complete dimensional stability. These properties combine to provide a freight car door which has a markedly lower maintenance cost and improved service life than conventional sheet metal doors.

What I claim as my invention is:

1. A structural panel comprising laminated planar outer layers of resin bonded glass fibre arranged on opposite faces of a relatively thick, lightweight core matrix, said core matrix comprising two sheets of low density material each bonded to the glass fibre outer layers on one side of the panel, and bonded together in confronting relationship in the neutral plane of the panel, and said outer layers of glass fibre on each face of the panel comprising successively from the outermost face (a) a layer of woven roving (b) a random fibre mat and (c) at least one layer of unidirectional fibres.

2. A structural panel according to claim 1 wherein said core sheets are of balsa wood arranged with the grain extending in the direction of the thickness of the panel.

3. A structural panel according to claim 2 wherein the balsa wood core sheets are resin bonded together on opposite sides of a central layer of glass fibre.

4. A structural panel according to claim 1, 2 or 3 wherein marginal regions of said outer layers extend around the peripheral edges of the panel in overlapping relationship to form stiffened panel edges.

5. A structural panel according to claim 1, 2 or 3 wherein marginal regions of said outer layers extend around the peripheral edges of the panel in overlapping relationship to form stiffened panel edges at least one of said panel edges being further strengthened by a channel shaped reinforcing element which has a web portion secured against the panel edge surface and a pair of spaced parallel flanges which overlie marginal areas of the opposite faces of said panel.

6. A railway freight car door comprising a structural panel according to claim 1, 2 or 3 said panel having bonded therein metal anchor plates providing attachment points for mounting and locking hardware for the door.

7. A structural panel comprising laminated planar outer layers of resin bonded glass fibre arranged on opposite faces of a relatively thick, lightweight core matrix, said core matrix comprising two sheets of balsa wood arranged with the grain extending in the direction of the thickness of the panel, each said sheet being bonded to the glass fibre outer layers on one side of the panel, and said sheets being bonded together in confronting relationship in the neutral plane of the panel.

8. A structural panel according to claim 7, wherein the fibres of said at least one layer of unidirectional fibres are aligned to an edge of the panel at an angle in the range 30° to 60°.

* * * * *